US008016692B2

(12) United States Patent
Kumamoto

(10) Patent No.: US 8,016,692 B2
(45) Date of Patent: Sep. 13, 2011

(54) GOLF CLUB AND GRIP FOR GOLF CLUB

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 68 days.

(21) Appl. No.: 12/232,807

(22) Filed: Sep. 24, 2008

(65) Prior Publication Data

US 2009/0143163 A1 Jun. 4, 2009

(30) Foreign Application Priority Data

Dec. 4, 2007 (JP) ..... 2007-313418

(51) Int. Cl.
*A63B 53/14* (2006.01)

(52) U.S. Cl. ..... 473/303

(58) Field of Classification Search ..... 473/300–303, 473/549–552, 568; D21/756; 74/551.9; 81/489; 16/DIG. 18, 19, 12, 430; 280/821; D8/DIG. 6, DIG. 7, DIG. 8
See application file for complete search history.

(56) References Cited

U.S. PATENT DOCUMENTS 1,890,037 A * 12/1932 Johnson ..... 473/300
D268,944 S * 5/1983 Southey ..... D21/756
5,355,552 A * 10/1994 Huang ..... 16/421
5,584,482 A * 12/1996 Huang ..... 473/301
6,428,865 B1 * 8/2002 Huang ..... 428/35.7
7,485,050 B2 * 2/2009 Rose ..... 473/303
2003/0088946 A1 * 5/2003 Ferguson et al. ..... 16/431

FOREIGN PATENT DOCUMENTS

JP 6-15019 A 1/1994
JP 9-187540 * 7/1997
JP 09187540 A * 7/1997

* cited by examiner

*Primary Examiner* — Stephen L. Blau
(74) *Attorney, Agent, or Firm* — Birch, Stewart, Kolasch & Birch, LLP

(57) ABSTRACT

A golf club (2) includes a head (4), a shaft (6) and a grip (8). At least one siping groove (g1) is provided on a surface of the grip (8). The siping groove (g1) is bent in a direction (Dd) of a depth of the grip. A width (Wg) of the siping groove (g1) is set to be equal to or greater than 0.15 mm and is equal to or smaller than 1.5 mm. It is preferable that an opening edge (e1) of the siping groove (g1) should be bent. The width (Wg) is more preferably equal to or greater than 0.20 mm. The width (Wg) is more preferably equal to or smaller than 1.4 mm and is further preferably equal to or smaller than 1.3 mm. A depth (F1) of the siping groove (g1) is preferably equal to or greater than 0.5 mm and is preferably equal to or smaller than 3.5 mm.

7 Claims, 10 Drawing Sheets

GOLF CLUB AND GRIP FOR GOLF CLUB

This application claims priority on Patent Application No. 2007-313418 filed in JAPAN on Dec. 4, 2007, the entire contents of which are hereby incorporated by reference.

BACKGROUND OF THE INVENTION

1. Field of the Invention

The present invention relates to a golf club and a grip for the golf club.

2. Description of the Related Art

A grip is attached to a golf club. In a swing, the grip is worn out. In order to suppress the wear, it is preferable that a material of the grip should be hardened. In the case in which the material of the grip is hardened, however, a grip feeling (a grip comfort) is apt to be deteriorated. In the case in which the material of the grip is hardened, a coefficient of friction is apt to be reduced. A grip having a low coefficient of friction is slippery. In the case in which sweat or rainwater sticks to a surface of the grip, particularly, the grip is slippery. It has been desired to obtain a grip which has a good grip feeling and is hard to slip.

Japanese Laid-Open Patent Publication No. 6-15019 has disclosed a grip for a golf club in which a recess portion for absorbing sweat is formed on a surface of the grip and has disclosed a cut and a groove having a very small width as the recess portion for absorbing sweat.

SUMMARY OF THE INVENTION

A pressing force and a twisting force act on a grip during a swing. A portion divided by a cut or a groove having a very small width (which will be hereinafter referred to as a block) might be caused to fall down by the forces. In the grip disclosed in the document, it has been found that the fall-down of the block is apt to be generated. Due to the fall-down, the grip might be excessively deformed during the swing. Due to the deformation of the grip which is caused by the fall-down, furthermore, a shaft axis might excessively fluctuate with respect to a grip axis, resulting in an unstable behavior of a club. The instability of the behavior of the club might also have a bad influence on a stability of the swing. Moreover, it has been found that a partial wear of the grip is apt to be caused by the fall-down.

It is an object of the present invention to provide a golf club which is hard to slip in wetting and can enhance a stability of a swing.

A golf club according to the present invention includes a head, a shaft and a grip. At least one siping groove is provided on a surface of the grip. The siping groove is bent in a direction of a depth of the grip. A width of the siping groove is set to be equal to or greater than 0.15 mm and is equal to or smaller than 1.5 mm.

It is preferable that an opening edge of the siping groove should be bent.

In a grip for a golf club according to the present invention, at least one siping groove is provided on a surface of the grip. The siping groove is bent in a direction of a depth of the grip. A width of the siping groove is set to be equal to or greater than 0.15 mm and is equal to or smaller than 1.5 mm in a state in which the grip is attached to a shaft.

By the siping groove bent in the direction of the depth, it is possible to suppress fall-down, thereby enhancing a stability of a swing. By the siping groove, moreover, it is possible to enhance a slipping difficulty in wetting.

DESCRIPTION OF THE PREFERRED EMBODIMENT

The present invention will be described below in detail based on a preferred embodiment with reference to the drawings.

Figure 1:
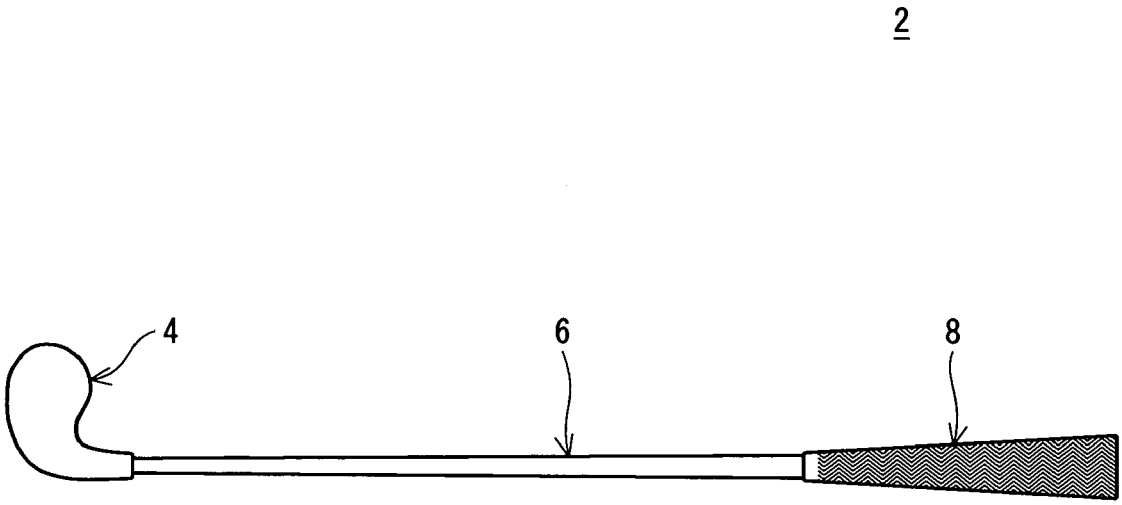
FIG. 1 is a general view showing a golf club according to an embodiment of the present invention.

As shown in FIG. 1, a golf club 2 has a golf club head 4, a golf club shaft 6 and a grip 8 for a golf club. The head 4 is attached to one of ends of the shaft 6. The grip 8 is attached to the other end of the shaft 6.

The head 4 is not restricted. Examples of the head 4 include a head of a wood type, a head of an iron type, and a putter head. The shaft 6 is not restricted. Examples of the shaft 6 include a so-called steel shaft and a so-called carbon shaft.

Figure 2:
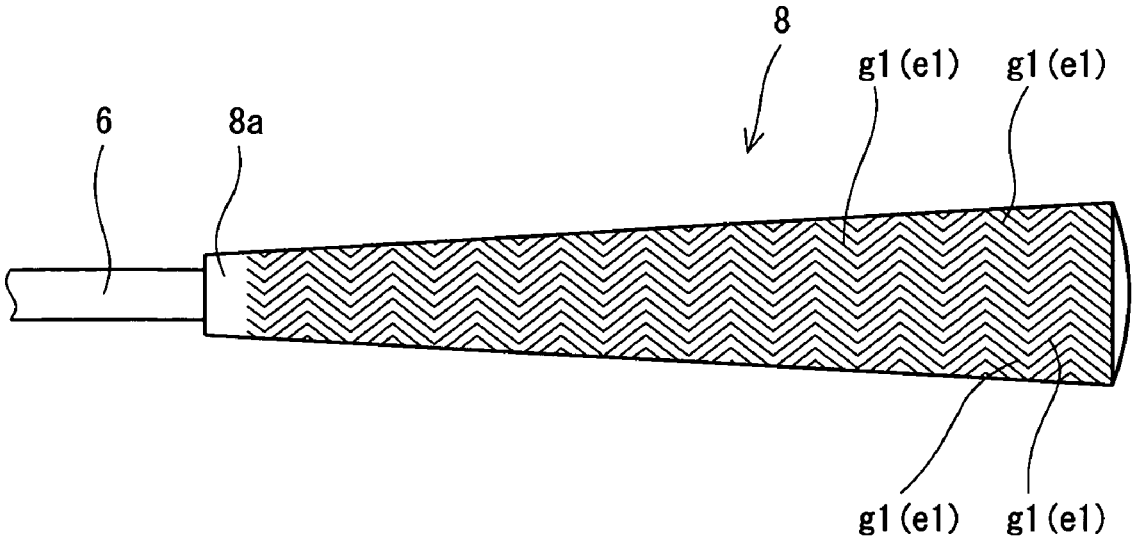
FIG. 2 is an enlarged view showing the vicinity of a grip in the golf club of FIG. 1.
Figure 3:
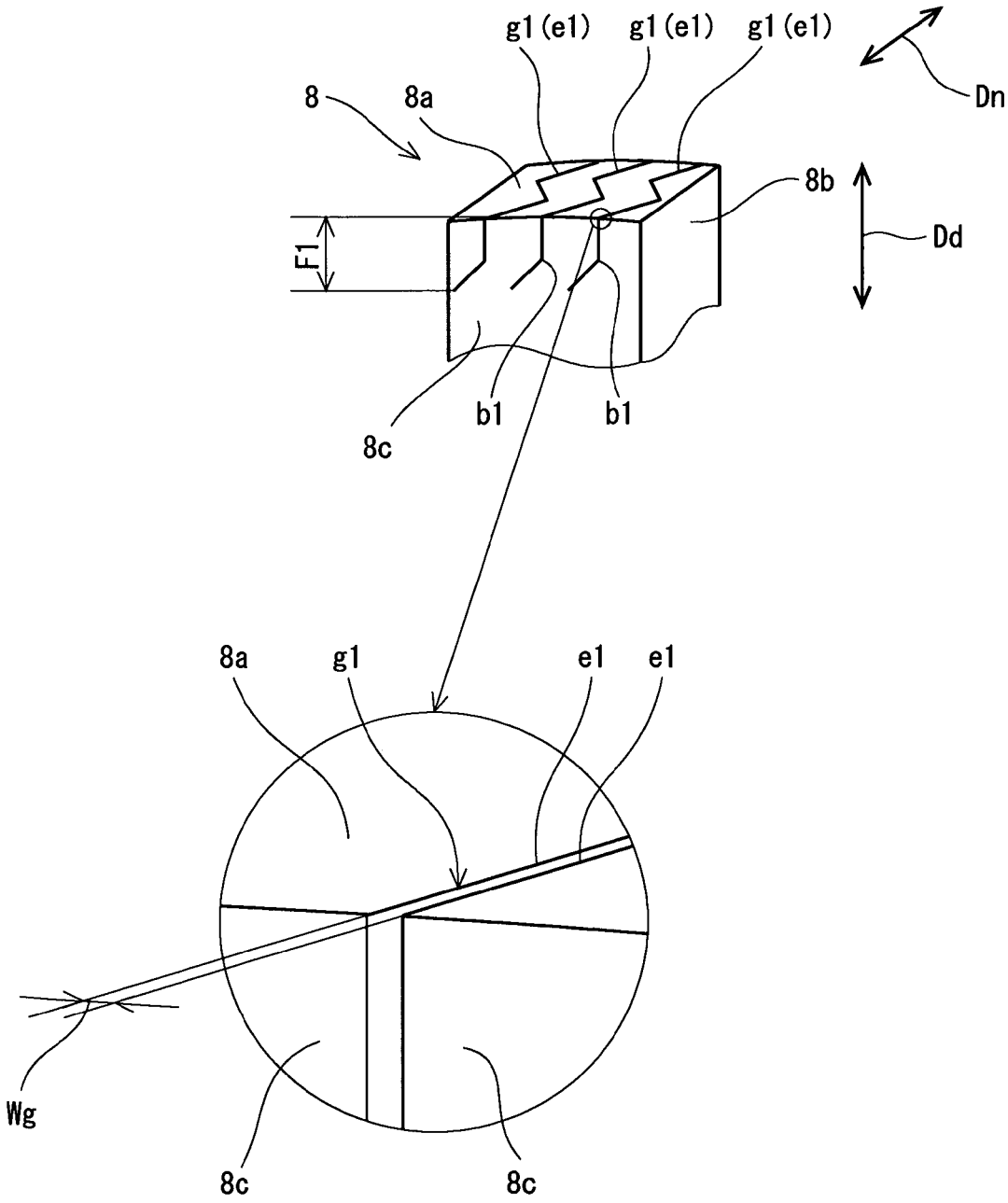
FIG. 3 is a perspective view showing a member obtained by cutting out the grip of FIG. 2 in a shape of an almost rectangular parallelepiped.

FIG. 2 is an enlarged view showing the grip 8 portion in FIG. 1. FIG. 3 is a perspective view showing a member obtained by cutting out the grip 8 of FIG. 2 in a shape of an almost rectangular parallelepiped. The perspective view of FIG. 3 shows a surface 8*a* of the grip 8, a section 8*b* of the grip 8 in a longitudinal direction (an axial direction) of the grip 8, and a section 8*c* of the grip 8 in a perpendicular direction to the longitudinal direction of the grip 8.

In FIG. 3, a double arrow Dn indicates the longitudinal direction of the grip 8. In FIG. 3, a double arrow Dd indicates a direction of a depth of the grip 8. For easy understanding of the drawing, an interval between grooves g1 is illustrated to be greater than an actual interval in FIG. 3.

The shaft 6 is cylindrical, which is not shown. The grip 8 is cylindrical, which is not shown. The surface 8*a* of the grip 8 is a curved surface taking an almost circular shape. The grip 8 has a so-called back line, which is not shown. Therefore, a sectional shape of the surface 8*a* is not a complete round. The sectional shape of the surface 8*a* is almost circular.

As shown in FIGS. 2 and 3, the groove g1 is provided on the surface 8*a* of the grip 8. A large number of siping grooves g1 are provided. As shown in FIG. 2, the siping groove g1 is bent in an appearance. More specifically, an opening edge e1 of the siping groove g1 is bent. The siping groove g1 is extended with bending over the surface of the grip 8. As shown in FIG. 2, the grip 8 has only the groove g1 as a groove.

The siping groove g1 is provided over a whole part in a circumferential direction of the grip 8, which is not shown. Moreover, the siping groove g1 is provided on a part in the longitudinal direction of the grip 8. In other words, the siping groove g1 is not provided in a tip portion of the grip 8.

In FIG. 3, a double arrow Wg indicates a width of the siping groove g1. The width Wg is equal to or greater than 0.15 mm and is equal to or smaller than 1.5 mm. The groove g1 has a small width. For this reason, the groove g1 is shown in a line in the drawings of the present application. The width Wg exceeds 0 mm. Accordingly, two opening edges e1 are actually present per groove g1 (see an enlarged part of FIG. 3). It is preferable that the two opening edges e1 possessed by the groove g1 should be parallel with each other. The groove g1 is different from a cut having no width Wg. In the present application, the groove is also referred to as the siping groove. In the present invention, a groove having a width exceeding 1.5 mm may be provided together with the siping groove g1.

The width Wg is measured in a state in which the grip 8 is attached to the shaft 6. In some cases, the grip 8 is extended in the circumferential direction through an insertion of the shaft 6. In some cases, therefore, the width Wg is greater than a groove width in the case in which the grip 8 is single. In some cases, the groove width in the case in which the grip 8 is single is 0.0 mm and the width Wg is equal to or greater than 0.15 mm.

The opening edge e1 is bent. The opening edge e1 is bent zigzag. A plurality of siping grooves g1 taking the same shape may be provided on the grip 8. The opening edge e1 is extended in the longitudinal direction of the grip 8 with a reciprocation in the circumferential direction of the grip 8. An interval between the adjacent siping grooves g1 is set to be constant. The adjacent opening edges e1 are parallel with each other. The opening edge e1 is bent almost periodically. The opening edge e1 may be bent aperiodically. The opening edge e1 may be bent randomly. The interval between the adjacent siping grooves g1 does not need to be constant.

In the present invention, a bending specification of the opening edge e1 is not restricted. The opening edge e1 may be bent as in the present embodiment or may be a smooth curve. For example, the opening edge e1 may be bent in a wavy shape. Moreover, it is sufficient that the opening edge e1 in the groove g1 is bent in at least one portion. In the present invention, it is also possible to mix a siping groove having the opening edge e1 which is bent and a siping groove having the opening edge e1 which is not bent.

As shown in FIG. 3, the siping groove g1 is bent in the depth direction Dd. More specifically, the siping groove g1 is bent in a section taken away in the depth direction Dd. Innumerable sections taken away in the depth direction Dd are present. Examples of the section taken away in the depth direction Dd include a section taken along a plane containing a shaft axis. Examples of the section taken away in the depth direction Dd include a section taken in a radial direction of a shaft. The section 8*c* shown in FIG. 3 is taken away in the radial direction of the shaft. The siping groove g1 is bent in at least the section 8*c*. A bending point b1 is present on the section 8*c*.

Thus, the siping groove g1 is bent in the depth direction. The siping groove g1 is bent in the depth direction. A plurality of siping grooves g1 having the same shape is provided on the grip 8. All of the siping grooves g1 are the same as in the grip. A siping groove g1 having a different specification may be provided.

In the present invention, a bending specification in the depth direction is not restricted. In the depth direction, the siping groove g1 may be bent or may be a smooth curve. For example, the siping groove g1 may be bent in a wavy shape in the depth direction. In the depth direction, moreover, it is sufficient that the siping groove g1 is bent in at least one portion. In the present invention, it is also possible to provide a groove which is not bent in the depth direction together with the siping groove g1.

A material of the grip is not restricted but a rubber composition and a resin composition are taken as an example. For a rubber in the rubber composition, it is possible to use a natural rubber (NR), an ethylene propylene diene rubber (EPDM), a styrene butadiene rubber (SBR), an isoprene rubber (IR), a butadiene rubber (BR), a chloroprene rubber (CR), an acrylonitrile butadiene rubber (NBR) and the like. In particular, it is preferable to use the natural rubber or a rubber obtained by blending, with the natural rubber, the ethylene propylene diene rubber or the styrene butadiene rubber which has a high affinity to the natural rubber or the like.

Oil may be blended with the rubber composition. It is possible to use aromatic oil, naphthenic oil, paraffinic oil or the like for the oil, for example.

In addition to the rubber, sulfur and the oil, a reinforcing agent, a filler, a vulcanization accelerator, a vulcanization assistant or the like may be properly blended with the rubber composition of the grip if necessary, for example. Furthermore, an anti-aging agent, a processing aid or the like may be blended.

For example, carbon, silica or the like can be used as the reinforcing agent. For example, hard clay, calcium carbonate, magnesium carbonate, clay or the like is used as the filler. For example, zinc oxide, stearic acid or the like is used for the vulcanization assistant. The vulcanization accelerator can be properly selected corresponding to a used rubber in accordance with a well-known method.

A resin composition can also be used for the material of the grip. Examples of a resin contained in the resin composition include a thermoplastic resin. The thermoplastic resin can be used for injection molding. For the thermoplastic resin, a thermoplastic elastomer is preferable and a thermoplastic elastomer containing a soft segment and a hard segment is more preferable. In respect of a consistency of a gripping property with an abrasion resistance, a thermoplastic polyurethane elastomer is more preferable.

A preferable blending ratio to 100 parts by weight of a rubber is obtained by 5 to 70 parts by weight of the reinforcing agent, 10 to 70 parts by weight of the filler, 0.1 to 3 parts by weight of the vulcanization accelerator, and 1 to 10 parts by weight of the vulcanization assistant. The ratio is not restricted.

A method of manufacturing the grip 8 is not restricted. The grip 8 can be manufactured by a well-known manufacturing method. Examples of the manufacturing method include press molding and injection molding.

In the press molding, a rubber composition is filled in a mold and a pressurization and heating are carried out. A heating temperature is usually set to be 130 to 200° C. and is not restricted thereto. A heating time is usually set to be 3 to 15 minutes and is not restricted thereto.

Figure 4:
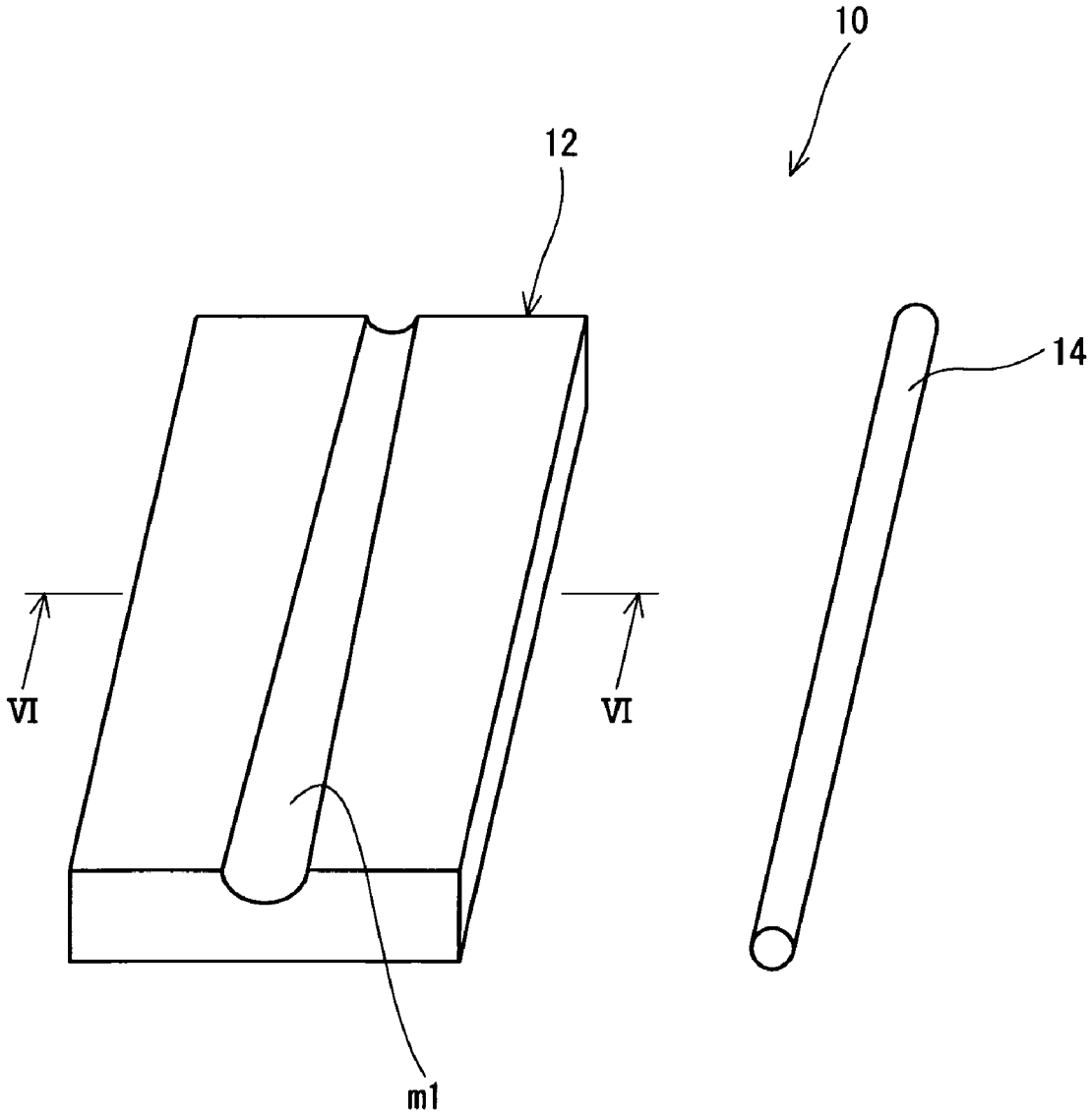
FIG. 4 is a perspective view showing an example of a mold for fabricating the grip.

FIG. 4 shows an example of a press mold 10 to be used for the press molding. The press mold 10 has a lower mold half 12, an upper mold half which is not shown, and a core mold (mandrel) 14. The upper mold half has the same structure as the lower mold half 12. The lower mold half 12 and the upper mold half have an internal mold surface m1 for forming an external surface of the grip. Furthermore, the press mold 10 has a tip member for forming a tip of the grip and a rear end member for forming a rear end of the grip, which is not shown. The tip member and the rear end member are almost disc-shaped. An engaging portion capable of being engaged with an end of the core mold 14 is provided in central parts of the tip member and the rear end member.

Description will be given to an example of a manufacturing method using the press mold 10. First of all, a rubber composition processed like a sheet is cut into a strap so that a rubber sheet for the lower mold half is obtained. The rubber sheet for the lower mold half is disposed on the internal mold surface m1 of the lower mold half 12. Next, the tip member, the rear end member and the core mold 14 are attached to the lower mold half 12. The tip member is attached to the tip portion of the internal mold surface m1. The rear end member is attached to the rear end of the internal mold surface m1. A tip of the core mold 14 is attached to the tip member. A rear end of the core mold 14 is attached to the rear end member. The core mold 14 thus attached is fixed with a clearance formed between the core mold 14 and the internal core surface m1. Then, a rubber sheet for the upper mold half is disposed on an upper side of the core mold 14. The rubber sheet for the upper mold half is the same as the rubber sheet for the lower mold half. Then, the upper mold half and the lower mold half 12 are brought face to face with each other so that the press mold 10 is closed. After the heating and the pressurization are ended, the press mold 10 is opened to take a molded product out. The core mold 14 is pulled out of the molded product so that the grip 8 is obtained. Although the rubber sheet for the upper mold half and the rubber sheet for the lower mold half are used for the materials to be filled in the press mold 10 in the manufacturing method, the materials to be filled may be wound around the core mold 14 in place thereof.

Figure 5:
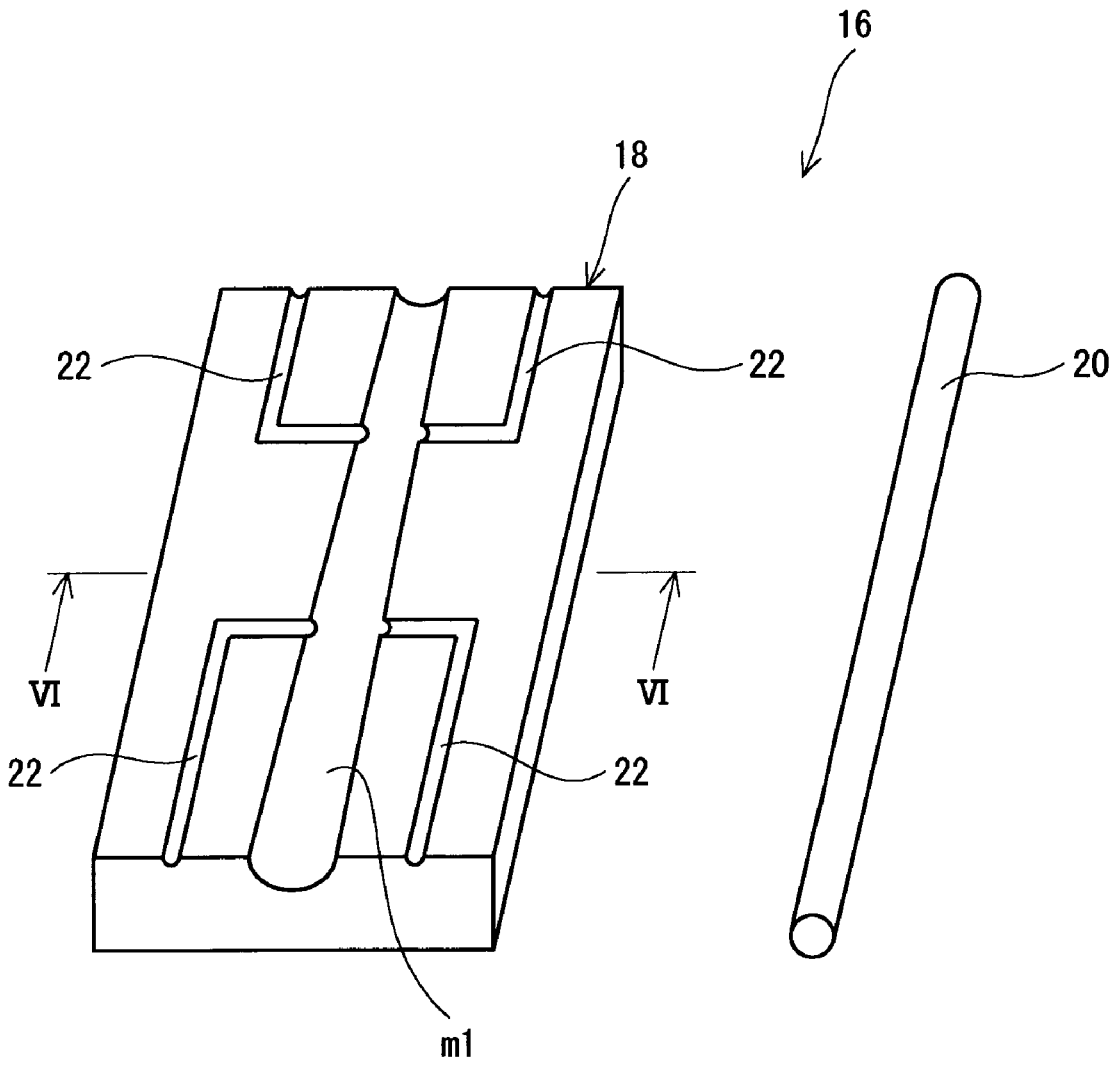
FIG. 5 is a perspective view showing an example of the mold for fabricating the grip.

FIG. 5 is a perspective view showing an example of an injection mold 16 to be used for the injection molding. The injection mold 16 has a lower mold half 18, an upper mold half which is not shown, and a core mold (mandrel) 20. The upper mold half has the same structure as the lower mold half 18. The lower mold half 18 and the upper mold half have an internal mold surface m1 for forming an external surface of the grip. Furthermore, the injection mold 16 has a tip member for forming a tip of the grip and a rear end member for forming a rear end of the grip, which is not shown. The tip member and the rear end member are almost disc-shaped. An engaging portion capable of being engaged with an end of the core mold 20 is provided in central parts of the tip member and the rear end member.

The lower mold half 18 and the upper mold half have a material injecting path 22. The material is injected from the material injecting path 22 into the mold.

As an example of a manufacturing method using the injection mold 16, the injection mold 16 is first closed and the material is then injected from the material injecting path 22. A structure of the closed injection mold 16 is the same as a structure of the press mold 10. Thereafter, a molded product is taken out. For the injection mold, it is also possible to use a mold which is not divided vertically in addition to the mold 16 shown in FIG. 5, for example.

Figure 6:
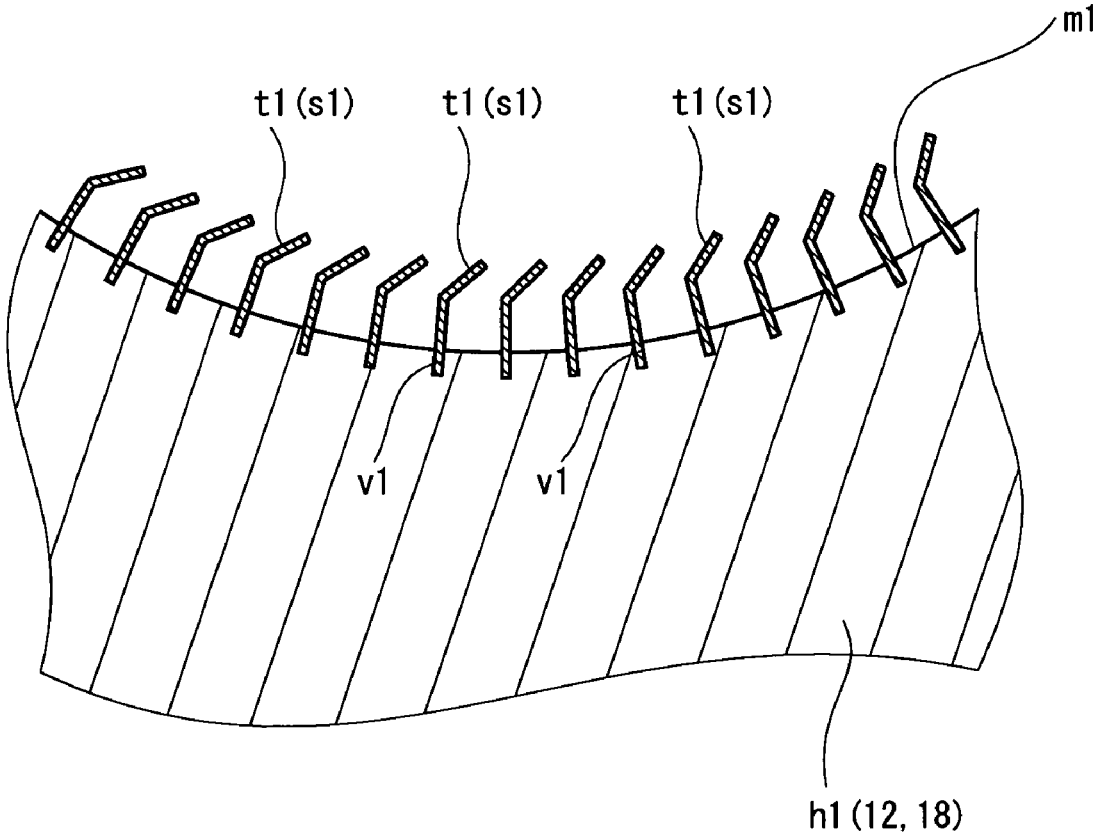
FIG. 6 is a sectional view taken along a VI-VI line in FIGS. 4 and 5.

FIG. 6 is a sectional view taken along a VI-VI line in FIGS. 4 and 5. The internal mold surface m1 is provided with a projecting portion t1 for forming the siping groove g1. A large number of projecting portions t1 are provided corresponding to the number of the siping grooves g1. In FIGS. 4 and 5, the projecting portion t1 is not shown.

The projecting portion t1 may be formed integrally with a mold body h1. Examples of the integral forming method include a method of casting a mold by a lost-wax process. In the case in which a large number of projecting portions t1 are provided, a great deal of time and labor is required for the integral molding.

In the present embodiment, a groove molding body s1 for forming the projecting portion t1 is used. The groove molding body s1 is formed separately from the mold body h1. The mold body h1 has an inserting groove v1 for inserting the groove molding body s1. The groove molding body s1 is inserted into the inserting groove v1 and is thus fixed to the mold body h1.

The groove molding body s1 takes a shape obtained by bending a thin plate. The groove molding body s1 can be fabricated by forging, casting or the like. In case of the groove molding body s1 taking a complicated shape, particularly, it is preferable that the groove molding body s1 should be cast. In respect of easiness of a processing into a complicated shape, a metal is preferable for the material of the groove molding body s1, and particularly, an aluminum alloy is more preferable. Moreover, one siping groove g1 may be formed by one groove molding body s1 or may be formed by a plurality of groove molding bodies s1.

The shape of the groove molding body s1 corresponds to the shape of the siping groove g1. A sectional shape of the groove molding body s1 is bent in the direction of the depth of the grip. As a groove molding body s1 according to another embodiment, a groove molding body s1 taking the Miura folding shape is taken. The Miura folding is obtained by combining parallelogram planes. The Miura folding is constituted by parallelograms divided by angular projection folding and angular recess folding. The parallelograms are congruent with each other. The Miura folding can fold a plane three-dimensionally without generating wrinkles of a strain. Accordingly, the groove molding body s1 taking the Miura folding can easily be formed. The Miura folding was invented by Professor Miura in The Institute of Space and Astronautical Science.

Water or sweat sticking to the surface of the grip 8 can enter an inner part of the sipping groove g1. Consequently, the water or sweat present on the surface of the grip 8 can be absorbed into the grip 8. By the siping groove g1, it is possible to enhance a gripping property in wetting. Moreover, the opening edge e1 of the siping groove g1 can produce a so-called edge effect. In other words, the opening edge e1 abuts on a surface of a human hand so that a slipping difficulty can be exhibited.

The grip 8 receives a force such as a pressing force or a twisting force from a hand of a player. By the force, the fall-down of the block might be generated as described above. By the siping groove g1 bent in the depth direction, the fall-down can be suppressed. By the siping groove g1 bent in the depth direction, a force acting on the grip is effectively dispersed so that the fall-down can be suppressed. Furthermore, the opening edge e1 is bent. Therefore, the dispersion of the force is promoted still more so that the fall-down suppressing effect can further be enhanced. By the fall-down suppressing effect, an excessive deformation of the grip is suppressed so that the behavior of the club in a swing can be stabilized.

In order to enhance the gripping property in wetting and to reduce a manufacturing cost for the mold, the width Wg is preferably equal to or greater than 0.15 mm and is more preferably equal to or greater than 0.20 mm. In some cases in which the width Wg is excessively great, the opening edge e1 touches a hand to generate a rough feeling. Consequently, a grip feeling might be deteriorated. In the case in which the width Wg is excessively great, moreover, a rigidity of the grip is reduced so that the behavior of the club might be unstable in the swing or the swing might be unstable. From these viewpoints, the width Wg is preferably equal to or smaller than 1.5 mm, is more preferably equal to or smaller than 1.4 mm and is further preferably equal to or smaller than 1.3 mm.

In FIG. 3, a double arrow F1 indicates a depth of the siping groove g1. The depth F1 is measured in the radial direction of the shaft 6 attached to the grip 8. In order to prevent the grip feeling from being excessively hard and to enhance the gripping property in the wetting, the depth F1 is preferably equal to or greater than 0.5 mm, is more preferably equal to or greater than 0.75 mm, and is further preferably equal to or greater than 1.0 mm. In order to easily carry out pull-out from the mold in the molding and to enhance the rigidity of the grip, thereby stabilizing the behavior of the grip and the swing, the depth F1 is preferably equal to or smaller than 3.5 mm, is more preferably equal to or smaller than 3.0 mm, and is further preferably equal to or smaller than 2.5 mm.

In order to suppress the excessive deformation of the grip, and particularly, to enhance the gripping property in drying, the JIS-A hardness of the grip is preferably equal to or greater than 30, is more preferably equal to or greater than 35, and is particularly preferably equal to or greater than 40. In order to prevent the grip feeling from being excessively hard and to enhance the gripping property in the wetting, the JIS-A hardness of the grip is preferably equal to or smaller than 70, is more preferably equal to or smaller than 60, and is particularly preferably equal to or smaller than 50. The JIS-A hardness is measured in accordance with the JIS-K-6253 provision.

Figure 7:
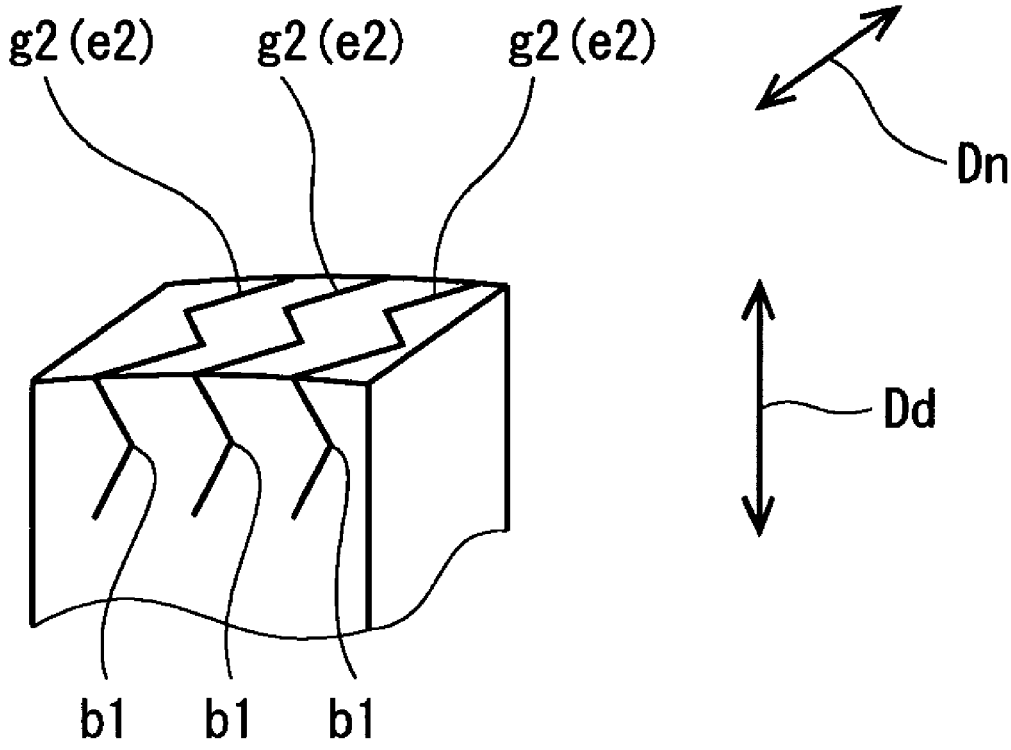
FIG. 7 is a perspective view showing a member obtained by cutting out a grip according to a variant in a shape of an almost rectangular parallelepiped.

FIG. 7 is a perspective view showing a member obtained by cutting out a grip according to a variant in a shape of an almost rectangular parallelepiped. The grip has a siping groove g2. The siping groove g2 has a bent portion b1 in one place in a depth direction Dd. A configuration of an opening edge e2 in the siping groove g2 is the same as a configuration of the opening edge e1 of the siping groove g1.

Figure 8:
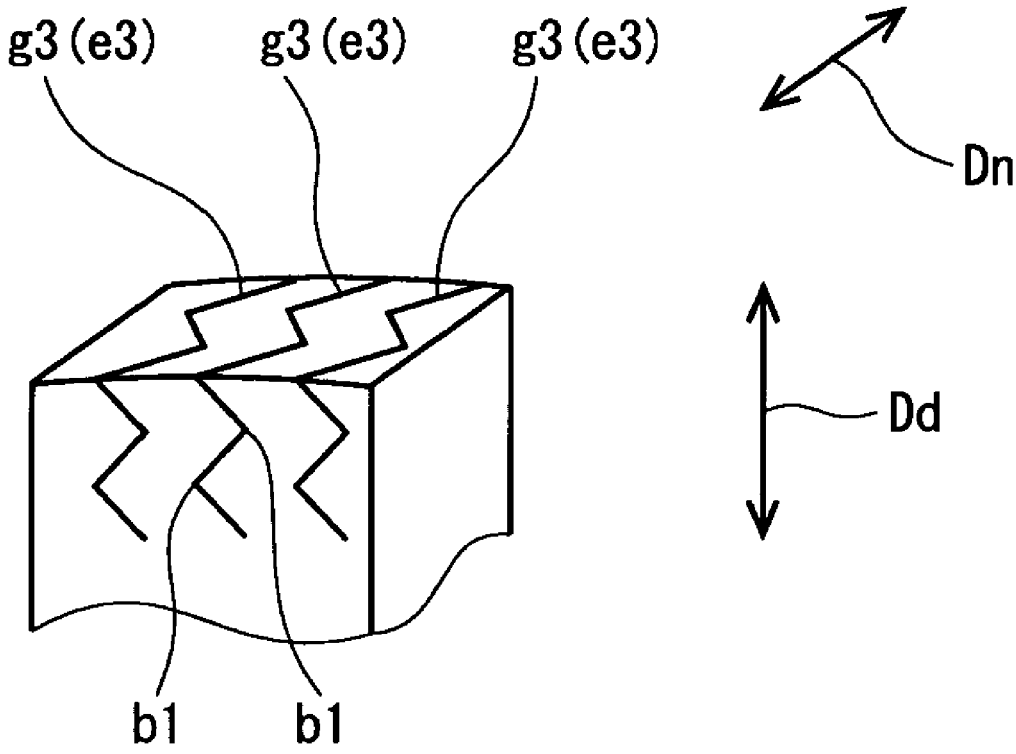
FIG. 8 is a perspective view showing a member obtained by cutting out a grip according to another variant in a shape of an almost rectangular parallelepiped.

FIG. 8 is a perspective view showing a member obtained by cutting out a grip according to another variant in a shape of an almost rectangular parallelepiped. The grip has a siping groove g3. The siping groove g3 has a bent portion b1 in two places in a depth direction Dd. The siping groove g3 is bent zigzag in the depth direction Dd. A configuration of an opening edge e3 in the siping groove g3 is the same as a configuration of the opening edge e1 of the siping groove g1.

Figure 9:
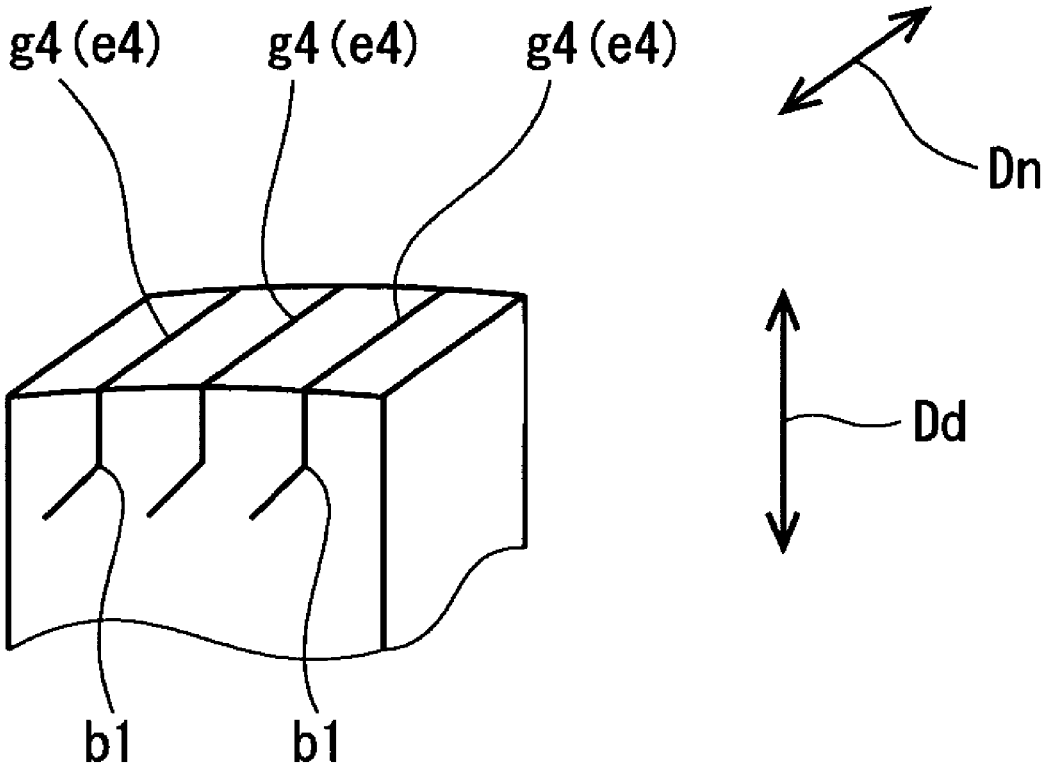
FIG. 9 is a perspective view showing a member obtained by cutting out a grip according to a further variant in a shape of an almost rectangular parallelepiped.

FIG. 9 is a perspective view showing a member obtained by cutting out a grip according to a further variant in a shape of an almost rectangular parallelepiped. The grip has a siping groove g4. An opening edge e4 of the siping groove g4 is provided in a longitudinal direction Dn of a grip. The opening edge e4 is provided along a shaft axis. The siping groove g4 has a bent portion b1 in one place in a depth direction Dd. A configuration of the opening edge e4 in the siping groove g4 is the same as a configuration of the opening edge e1 of the siping groove g1.

In the present invention, an installation range of the siping groove is not restricted. The siping groove may be provided over the whole surface of the grip or a part of the surface of the grip. The siping groove may be provided over a whole part in the circumferential direction of the grip or a part in the circumferential direction of the grip.

EXAMPLES

Although the advantages of the present invention will be apparent from examples, the present invention should not be construed restrictively based on description of the examples.

Example 1

1.8% by weight of sulfur, 62.5% by weight of polyisoprene (an isoprene rubber), 5.5% by weight of carbon black, and 22.2% by weight of an inorganic component were blended to obtain a rubber composition. For the inorganic component, $Al_2O_3$, $SiO_2$, CaO, $Fe_2O_3$, ZnO and $BaSO_4$ were used. The rubber composition was subjected to press molding by using the press mold so that a grip according to an example 1 was obtained. The siping groove shown in FIG. 9 was formed on the grip. An interval between the adjacent siping grooves was set to be 2 mm. The JIS-A hardness of the grip was 45. The width Wg was set to be 0.30 mm. A depth F1 of the siping groove was set to be 2.50 mm. The grip was attached to a rear end of a shaft and a head was attached to a tip portion of the shaft so that a golf club according to the example 1 was obtained.

Example 2

A grip and a golf club according to an example 2 were obtained in the same manner as in the example 1 except that a configuration of a siping groove was set to be the configuration shown in FIG. 7.

Comparative Example 1

Figure 10:
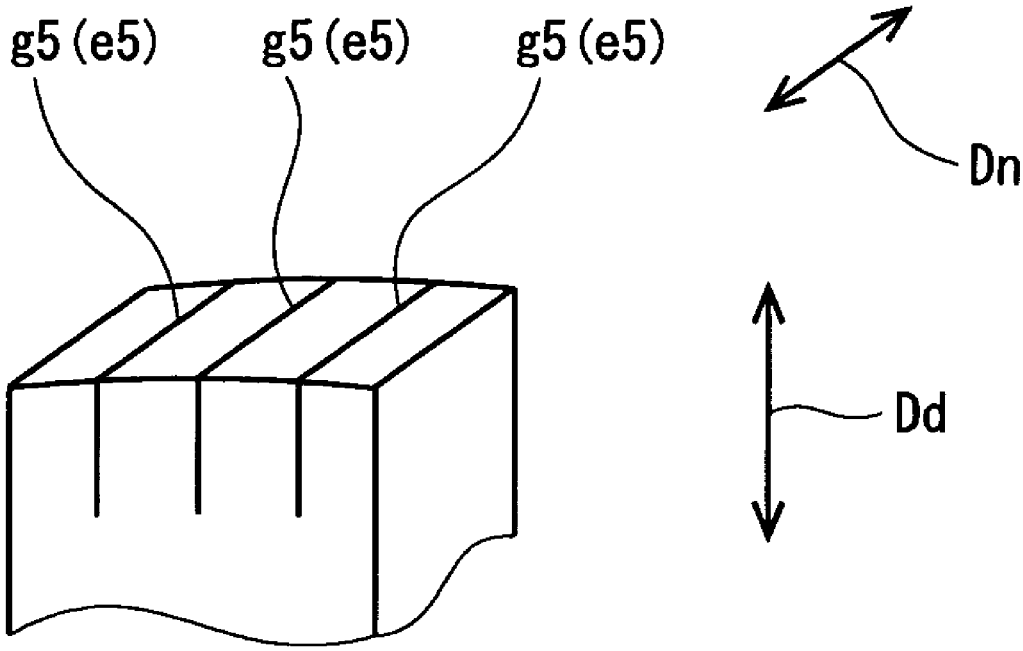
FIG. 10 is a perspective view showing a member obtained by cutting out a grip according to a comparative example 1 in a shape of an almost rectangular parallelepiped.

A grip and a golf club according to a comparative example 1 were obtained in the same manner as in the example 1 except that a configuration of a siping groove was set to be the configuration shown in FIG. 10. In the grip according to the comparative example 1, an opening edge e5 of a siping groove g5 is not bent. Moreover, the siping groove g5 is not bent in a depth direction Dd.

Comparative Example 2

A grip and a golf club according to a comparative example 2 were obtained in the same manner as in the comparative example 1 except that a depth F1 was changed to be 1.00 mm.

Specifications and evaluation results in the examples and the comparative examples are shown in the following Table 1.

The examples and the comparative examples were evaluated by the following method.

[Wear Test]

A surface of a grip was worn by means of a Gakushin type friction testing machine using No. 220 sandpaper in place of white cotton in accordance with the JIS L 0849 provision. An amount of wear was measured by 500 sliding operations of a cut grip piece and the sandpaper. An index number of the amount of wear is shown in the following Table 1. The amount of wear is expressed in an index number with an amount of wear in the example 1 set to be 100. The index number is shown in the following Table 1. A greater index number indicates a larger amount of wear.

[Feeling]

Ten golf players evaluated a stability of a swing in five grades of one to five marks. An evaluation of the example 1 was set to be three marks, the highest mark was set to be five and the lowest mark was set to be one. An average value of the ten golf players is shown in the following Table 1. The mark was rounded below a decimal place. A smaller deformation of a grip and a higher stability of the swing were set to be higher marks. An insufficient rigidity of the grip and a lower stability of the swing were set to be lower marks. The feeling was evaluated in a state in which a surface of the grip was not wetted (a dry state).

[Gripping Property]

The surface of the grip was wetted and a swing was then carried out, and a gripping property in wetting was evaluated. An evaluation in the example 1 was set to be three marks, the highest mark was set to be five, and the lowest mark was set to be one. An average value of the ten golfers is shown in the following Table 1. The mark was rounded below a decimal place. A smaller slip of the grip was set to be a higher mark. A greater slip was set to be a lower mark.

TABLE 1

Specification and Evaluation Result of Example and Comparative Example

| | Comparative Example 1 | Comparative Example 2 | Example 1 | Example 2 |
|---|---|---|---|---|
| View showing Configuration of Siping Groove | FIG. 10 | FIG. 10 | FIG. 9 | FIG. 7 |
| Width of Siping Groove Wg (mm) | 0.30 | 0.30 | 0.30 | 0.30 |
| Depth of Siping Groove F1 (mm) | 2.50 | 1.00 | 2.50 | 2.50 |
| Shape of Opening Edge | Straight | Straight | Straight | Zigzag |
| Number of Bent Point(s) in Direction of Depth of Siping Groove | 0 | 0 | 1 | 1 |
| Wearing Property | 111 | 106 | 100 | 92 |
| Feeling (dry) | 2 | 3 | 3 | 4 |
| Gripping Property (wet) | 3 | 2 | 3 | 3 |
| Interval between Siping Grooves (mm) | 2 | 2 | 2 | 2 |
| JIS - A Hardness | 45 | 45 | 45 | 45 |

As shown in the Table 1, the evaluation of the examples is higher than the evaluation of the comparative examples. From the results of the evaluation, the advantage of the present invention is apparent.

The present invention can be applied to grips of all golf clubs. Examples of the golf club include a golf club of a wood type, a golf club of an iron type and a patter club.

The above description is only illustrative and various changes can be made without departing from the scope of the present invention.

What is claimed is:

1. A golf club comprising a head, a shaft and a grip attached to the shaft, wherein at least one siping groove is provided in an outer surface of the grip, the outer surface of the grip surrounds a portion of the shaft and extends longitudinally along and circumferentially about the shaft, a depth direction is a direction into the grip from the outer surface and normal to the outer surface;

the siping groove extends into the grip from the outer surface, has at least one portion with an orientation that deviates from the depth direction and has at least one other portion, located at a different depth from the at least one portion, with an orientation relative to the depth direction that is different from the orientation of the at least one portion, and a width of the siping groove in a direction aligned with the outer surface is set to be equal to or greater than 0.15 mm and is equal to or smaller than 1.5 mm; and wherein the grip is formed by a mold having (1) a mold body and (2) a groove molding body formed separately from the mold body and fixed to the mold body; and the siping groove is formed by the groove molding body.

2. The golf club according to claim 1, wherein an opening edge of the siping groove at the outer surface is bent.

3. The golf club according to claim 1, wherein the portions of the siping groove form a smooth curve.

4. The golf club according to claim 1, wherein the portions of the siping groove are joined by a bend or bends located below the outer surface.

5. A grip for attachment to the shaft of a golf club, wherein at least one siping groove is provided in an outer surface of the grip, and wherein the outer surface of the grip, when the grip is attached to the shaft, surrounds a portion of the shaft and extends longitudinally along and circumferentially about the shaft, a depth direction is a direction into the grip from the outer surface and normal to the outer surface;

the siping groove extends into the grip from the outer surface, has at least one portion with an orientation that deviates from the depth direction and has at least one other portion, located at a different depth from the at least one portion, with an orientation relative to the depth direction that is different from the orientation of the at least one portion, and a width of the siping groove in a direction aligned with the outer surface is set to be equal to or greater than 0.15 mm and is equal to or smaller than 1.5 mm in a state in which the grip is attached to a shaft; and wherein the grip is formed by a mold having (1) a mold body and (2) a groove molding body formed separately from the mold body and fixed to the mold body; and the siping groove is formed by the groove molding body.

6. The grip for a golf club according to claim 5, wherein the portions of the siping groove form a smooth curve.

7. The grip for a golf club according to claim 5, wherein the portions of the siping groove are joined by a bend or bends located below the outer surface.

* * * * *